US006497073B2

(12) United States Patent
Webb

(10) Patent No.: US 6,497,073 B2
(45) Date of Patent: Dec. 24, 2002

(54) DOOR SAFETY DEVICE

(76) Inventor: Stephen Robert Webb, 385 Chepstow Avenue, Hornchurch Essex RM12 BAU (GB)

( * ) Notice: Subject to any disclaimer, the term of this patent is extended or adjusted under 35 U.S.C. 154(b) by 0 days.

(21) Appl. No.: 09/423,051

(22) PCT Filed: May 1, 1997

(86) PCT No.: PCT/GB97/01193

§ 371 (c)(1),
(2), (4) Date: Nov. 1, 1999

(87) PCT Pub. No.: WO98/50665

PCT Pub. Date: Nov. 12, 1998

(65) Prior Publication Data

US 2002/0046501 A1 Apr. 25, 2002

(51) Int. Cl.[7] ..... E06B 7/28
(52) U.S. Cl. ..... 49/383; 160/40; 16/250
(58) Field of Search ..... 47/383; 16/250, 16/251; 160/40

(56) References Cited

U.S. PATENT DOCUMENTS

| | | | | | |
|---|---|---|---|---|---|
| 2,694,234 | A | * | 11/1954 | Roby et al. | 49/383 |
| 3,302,690 | A | * | 2/1967 | Hurd | 160/40 |
| 4,040,142 | A | * | 8/1977 | Ippolito | 16/251 |
| 4,261,140 | A | * | 4/1981 | McLean | 49/383 |
| 5,092,077 | A | * | 3/1992 | Teinturier-Milgram | 49/383 |
| 5,220,708 | A | * | 6/1993 | Lucas et al. | 16/225 |
| 5,359,812 | A | * | 11/1994 | Mayfield | 49/383 |
| 5,419,084 | A | * | 5/1995 | Sankey et al. | 49/383 |

FOREIGN PATENT DOCUMENTS

| | | | | |
|---|---|---|---|---|
| FR | 2282032 A | | 3/1976 | |
| FR | 2565622 A | | 12/1985 | |
| GB | 2119838 A | | 11/1983 | |
| GB | 2218449 | * | 11/1989 | 49/383 |
| GB | 2247039 A | | 2/1992 | |
| GB | 2306538 A | | 5/1997 | |
| WO | 90 12945 A | | 11/1990 | |

* cited by examiner

*Primary Examiner*—Gregory J. Strimbu
(74) *Attorney, Agent, or Firm*—Banner & Witcoff, Ltd.

(57) ABSTRACT

A door safety device including a cover for a gap at a hinge side of a door and door frame combination. The cover includes a strip of a rigid material that is flexible about its major axis. The strip has attachment members at its long edges whereby each edge may be secured respectively to the door and door frame. The attachment members are arranged such that one edge of the strip is firmly fixed to one of the door and door frame combination and the other edge is fixed to the other member of the combination in a way that allows some vertical movement of that edge. The strip is formed with rigid portions and longitudinally directed fold areas such that part of the cover may be supported against a vertical edge of the door when the door is in an open condition. The safety cover can be fitted to doors either a coventional or a rising-butt type of hinge and it can prevent a child's hand from being inserted into the gap and thus being at risk of injury.

16 Claims, 4 Drawing Sheets

DOOR SAFETY DEVICE

FIELD OF THE INVENTION

This invention relates to a door safety device. It relates particularly to a device for fitting at the hinge side of a door and door frame in order to reduce the risk of injury to a child's fingers if they should attempt to enter this space.

BACKGROUND OF THE INVENTION

When a door is in the open position, the hinge side of the opening between the door side and the door frame offers a gap into which a young child's hand or fingers can very easily be inserted. If the door should then be closed, possibly by another child or by pressure from a draught of wind, there is a serious risk that the hand or fingers will become hurt or badly damaged. In time, of course, any child will learn that the gap at the edge of a door that is being closed is a dangerous area in the home and any fingers should be kept well away from this zone. However, the younger child will not be aware of this risk and may suffer a crushed finger.

SUMMARY OF THE INVENTION

The present invention was devised to provide a shield that would reduce the risk of injury to a child's hand.

According to the invention, there is provided a door safety device comprising a cover for the gap at the hinge side of a door and door frame combination, the cover comprising a strip of a rigid material which is flexible about its major axis, the strip having attachment means at its long edges so that one edge may be secured to the door and the other edge to the door frame of the combination, the attachment means being such that one edge is firmly fixed to one of the door/door frame combination whilst the second edge is fixed in a manner that allows a vertical movement of that edge with respect to the other one of the door/door frame combination, and the cover being formed with rigid portions and longitudinally-directed fold areas, so that when the door is opened the vertical door edge can form a support for one rigid portion of the device whereby the device will be maintained in a generally convex attitude throughout the operation of opening and closing of the door.

The cover may be formed of four rigid portions connected by three fold areas. The cover may be made of a fibrous or fluted board material.

The attachment means at one side of the strip may include the strip edge being formed in a T-shape and this edge being positioned in a C-shaped housing which will hold the T-shape yet allow the necessary vertical movement.

BRIEF DESCRIPTION OF THE INVENTION

Figure 1:
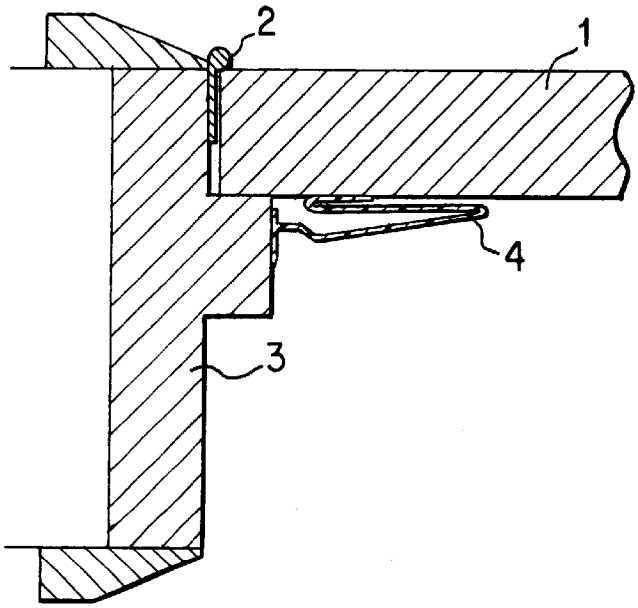
Figure 2:
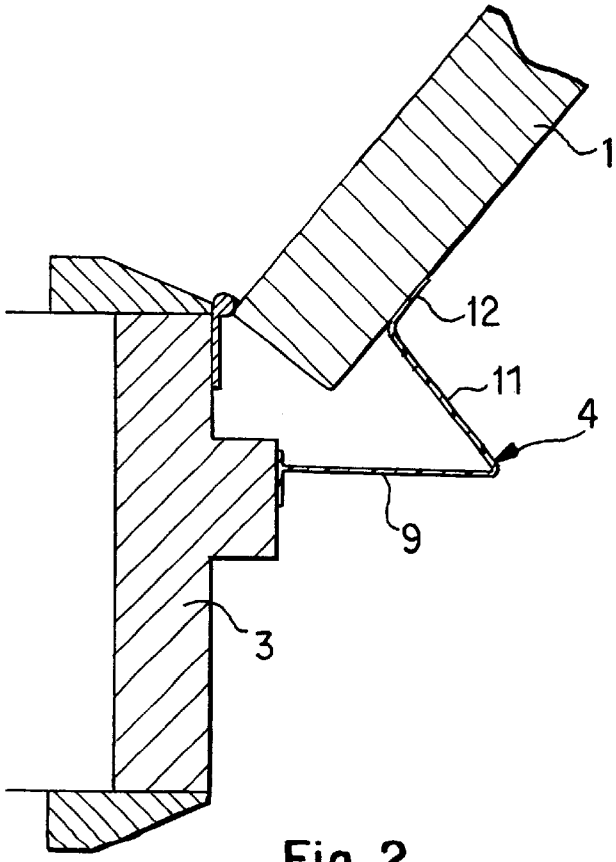
Figure 3:
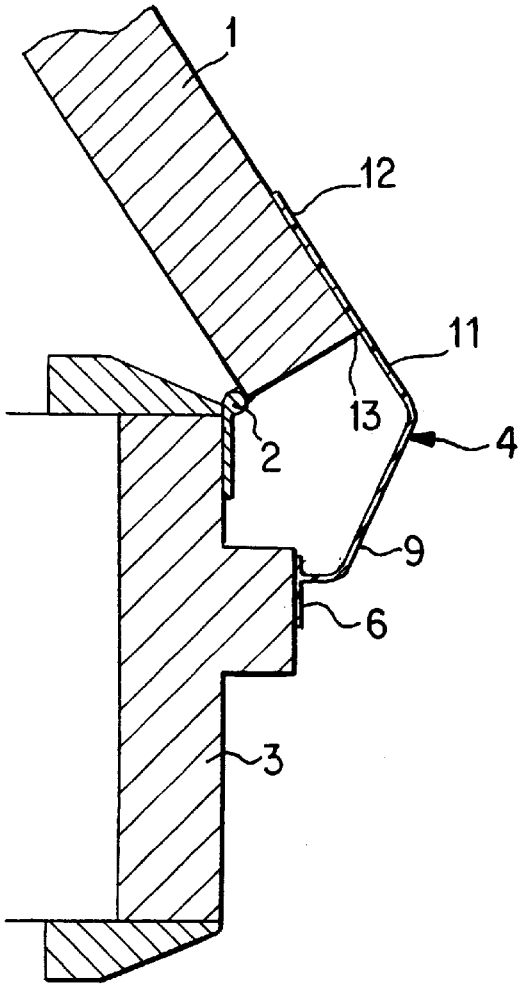
Figure 4:
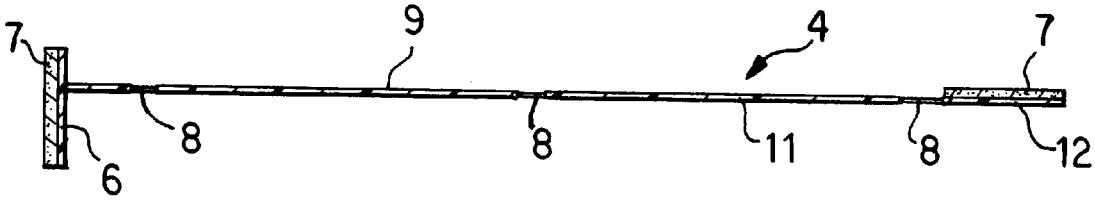
Figure 5:
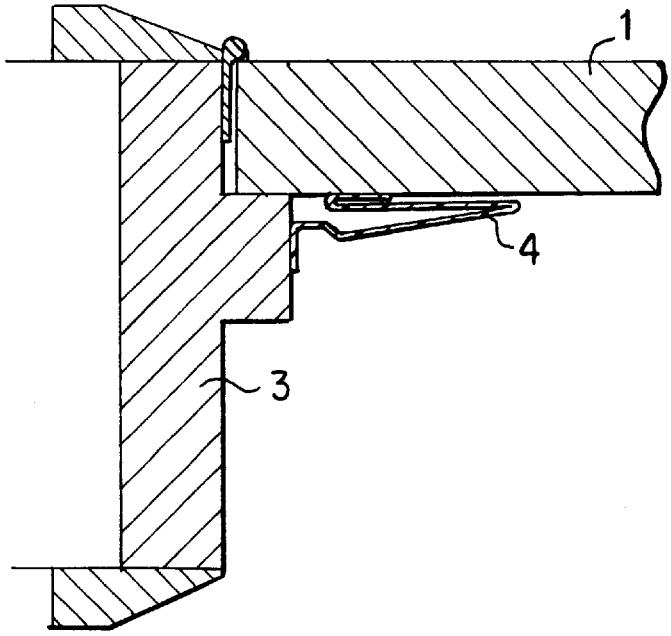
Figure 6:
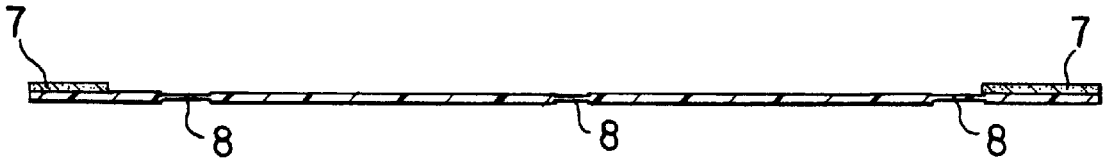
Figure 7:
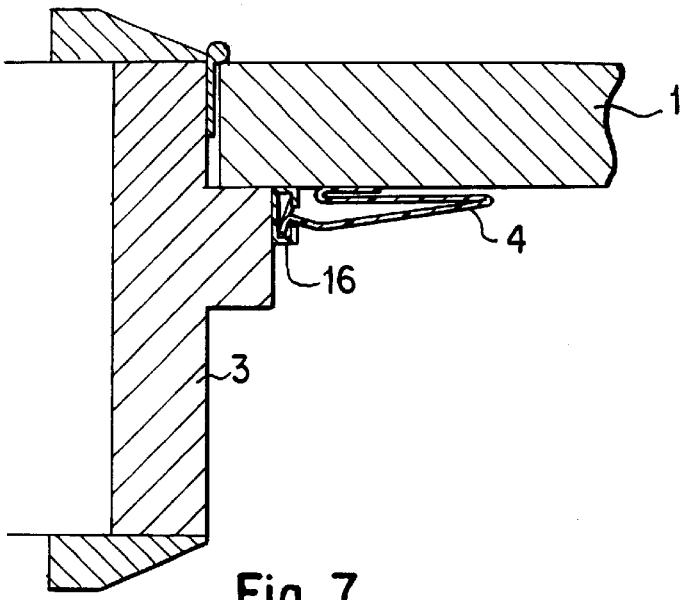
Figure 8:
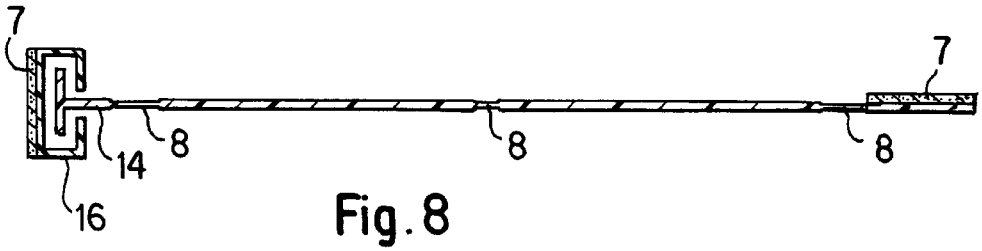
Figure 9:
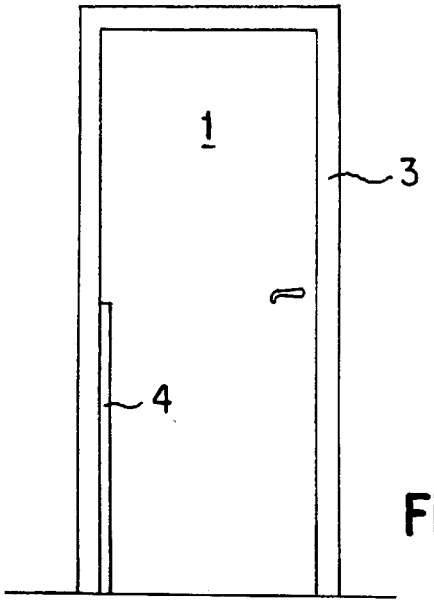

By way of example, some particular embodiments of the invention will now be described with reference to the accompanying drawings, in which:

FIG. 1 is a partial horizontal cross-sectional view through a door and door frame when fitted with the door safety device, FIG. 2 is a view similar to that of FIG. 1 when the door has been opened through an angle of sixty degrees, FIG. 3 is a similar view when the door has been opened fully, FIG. 4 is a cross-sectional view through the safety device, FIGS. 5 and 6 are similar views of a different embodiment of safety device, FIGS. 7 and 8 show a further embodiment of the invention, and, FIG. 9 depicts on a reduced scale a view of a door and door frame with a fitted safety device.

DETAILED DESCRIPTION OF THE INVENTION

As shown particularly in FIG. 1, the safety device is intended to be fitted at the hinge side of a door located in a door frame so that it will cover the large gap that appears when the door is opened. It is not necessary for the device to extend the full length of the vertical door side because a young child cannot be expected to reach very far up the door side. Therefore, a cover which extends a little more than halfway up the door side is likely in practice to be sufficient protection.

FIGS. 1 to 3 show the door being opened to different angles with respect to the door frame. The door 1 is mounted on hinges 2 that are located on the door frame 3. The safety device 4 is adhesively secured at one side to the door 1 and at the other side to the door frame 3. When the door is in the closed position (FIG. 1), the safety device 4 forms a flattened shape which occupies the comer where the door and frame come together. As the door is opened, the device 4 unfolds into a generally convex shape (FIGS. 2 and 3) which will tend to cover over the gap that appears with the greater angle of opening. A child's fingers will thus be prevented from entering this gap so there will be a reduced risk of accidental damage when the door closes. Upon closure of the door, the safety device 4 becomes folded again so that it will return to the position of FIG. 1.

FIG. 4 shows a cross-sectional view of the safety device which was made of a PVC composition with sections of rigid and flexible material. At the left hand side, the view depicts a T-shaped foot 6 which carries an adhesive pad 7. The foot 6 is attached by means of a fold area 8 to a rigid portion 9 and then by a further fold area 8 to a second rigid portion 11. The second rigid portion 11 is attached by another fold area 8 to a plate 12 on which a further adhesive pad 7 is located.

In operation of the safety device, the pads 7 are secured in the positions shown in FIG. 1 to the door and door frame. The installation is effected with the rigid portions (9,11) being bent about their connecting fold area 8. Upon opening the door 1, the rigid portions (9,11) then unfold from one another and open outwards so that a convex shield is provided over the door edge gap. When the door reaches the position depicted in FIG. 3, the second rigid portion 11 is seen to lie in contact with the flat surface of the door 1 so that the door edge 13 forms a fulcrum for supporting the rigid portion 11. The door edge 13 thus serves to maintain the convex shape of the safety device 4 so that it is unlikely to be distorted by pressure from a child's fingers.

FIGS. 5 and 6 show a further embodiment which is particularly suitable for being made from a fibrous board material such as a rigid cardboard, a fluted board or a board made of a plastics material. The different parts have the same reference numerals as those already described. In FIG. 6, the fold areas 8 are made by a creasing operation on the board.

Whilst the embodiments already described are suitable for use on doors with conventional door hinges, there is also in common use a different hinge termed a rising-butt hinge which allows a small vertical movement of the door upon opening so that a raised carpet edge can be cleared. The embodiment shown in FIGS. 5 and 6 is readily adapted for this type of hinge since the board material of the device can be allowed vertical movement by providing a vertical column of diagonally directed slits along the length of the device. There are also other ways of obtaining the vertical movement capability such as combinations of cutting and creasing and these techniques will be well-known to those familiar with this material.

In order to provide a safety device that was suited to both conventional and rising-butt door hinges, the embodiment shown in FIGS. 7 and 8 was devised. In this construction, the foot 6 is replaced by an anchor 14 in the shape of a letter T which is capable of being secured in a C-shaped housing 16. The housing 16 is provided with its own adhesive pad 7 by which it may be attached to the door frame 3. The housing 16 thus forms a secure fixing for the anchor 14 but it permits the anchor to move up and down along the housing as may be required to compensate for the vertical movement of a door mounted on rising-butt hinges.

FIG. 9 shows a door 1 located in a door frame 3 with the safety device 4 of the invention mounted at the hinge side of the door 1. It will be seen that the device 4 does not need to extend up the full height of the door because a young child will not be able to reach much more than halfway up the door. The safety device 4 is designed to fold automatically upon closure of the door so that it can remain unobtrusive in appearance.

The foregoing description of embodiments of the invention has been given by way of example only and a number of modifications may be made without departing from the scope of the invention as defined in the appended claims. For instance, instead of the safety device edges being secured by adhesive pads, an alternative method such as screw fixings could be used. The plastics material used for the safety device has been described as a combination of rigid and flexible PVC material. This is preferably a translucent PVC or even a PVC that has been given a light blue tint. The fold areas 8 and rigid portions 9 can be formed together in a co-extrusion process. It is also preferred that the safety device will have an unobtrusive appearance when it is located on the protected door and there are likely to be many other plastics and alternative materials that will fulfil this object.

What is claimed is:

1. A door safety device comprising a cover for a gap at a hinge side of a door and door frame combination, the cover comprising a strip of a rigid material, said strip being flexible about its major axis, said strip including first and second long edges, said second long edge having a T-shape, and attachment members, a first one of the attachment members being rigidly fixed to the first long edge of the strip and being configured and arranged for being rigidly fixed directly to one of the door and the door frame so that said first long edge of the strip is rigidly secured to the one of the door and the door frame when said first one of the attachment members is rigidly fixed to the one of the door and the door frame and a second one of the attachment members for being rigidly fixed to the other of the door and the door frame, said second one of the attachment members including a C-shaped housing that receives the T-shaped second long edge of the strip so that the T-shaped second long edge is positioned in the C-shaped housing and can move vertically with respect to the other of the door and the door frame, and said strip including rigid portions and fold areas, wherein when the door is in an open position a vertical door edge is capable of forming a support for one of the rigid portions of the cover whereby the cover will be maintained in a generally convex shape while the door is being opened and closed.

2. A device as claimed in claim 1, in which the cover includes a plastics material.

3. A method of making a door safety device as claimed in claim 2, the method comprising the step of moulding said strip of rigid material in a plastics extrusion operation.

4. A device as claimed in claim 1, wherein said rigid portions comprise four rigid portions, said four rigid portions being connected together via the fold areas.

5. A method of making a door safety device as claimed in claim 4, the method comprising the step of moulding said strip of rigid material in a plastics extrusion operation.

6. A device as claimed in claim 4, in which the cover comprises a plastics material with said fold areas being integrally formed with said rigid portions.

7. A device as claimed in claim 4, in which the cover includes a fibrous or fluted board material.

8. A device as claimed in claim 1, in which the cover comprises a plastics material with said fold areas being integrally formed with the rigid portions.

9. A method of making a door safety device as claimed in claim 1, the method comprising the step of moulding said strip of rigid material in a plastics extrusion operation.

10. A method of making a door safety device as claimed in claim 1, the method comprising the step of moulding said strip of rigid material in a plastics extrusion operation.

11. A method as claimed in claim 10, including the further step of forming the fold areas of the strip from a plastics material by a coextrusion process.

12. A device as claimed in claim 1, in which the cover includes a fibrous or fluted board material.

13. A door safety device comprising a cover for a gap at a hinge side of a door and door frame combination, the cover comprising a strip of a rigid material, said strip being flexible about its major axis, said strip including first and second long edges, said second long edge having a T-shape, and attachment members, a first one of the attachment members being rigidly fixed to the first long edge of the strip and for being rigidly fixed to one of the door and the door frame so that said first long edge of the strip is rigidly secured to the one of the door and the door frame when said first one of the attachment members is rigidly fixed to the one of the door and the door frame and a second one of the attachment members having a C-shaped housing for being rigidly fixed to the other of the door and the door frame, said C-shaped housing receiving the T-shaped second long edge of the strip so that the second long edge can move vertically with respect to said other of the door and door frame, and said strip including rigid portions and longitudinally-directed fold areas, wherein when the door is in an open position a vertical door edge is capable of forming a support for one of the rigid portions of the cover whereby the cover will be maintained in a generally convex shape while the door is being opened and closed.

14. A device as claimed in claim 13, in which the cover comprises a plastics material, and wherein said fold areas are integrally formed with said rigid portions.

15. A method of making a door safety device as claimed in claim 13, the method comprising the step of moulding said strip of rigid material in a plastics extrusion operation.

16. A door safety device comprising a cover for a gap at a hinge side of a door and door frame combination, the cover comprising a strip of a rigid material, said strip being flexible about its major axis, said strip including four rigid portions each connected to an adjacent one of the rigid portions by a respective one of three fold areas, said strip further including first and second long edges, said second long edge having a T-shape, and attachment members, a first one of the attachment members being rigidly fixed to the first long edge of the strip and for being rigidly fixed to one of the door and the door frame so that said first long edge of the strip is rigidly secured to the one of the door and the door frame when said first one of the attachment members is rigidly fixed the to the one of the door and the door frame and a second one of the attachment members having a C-shaped housing for being rigidly fixed to the other of the door and the door frame, said C-shaped housing receiving the T-shaped second long edge of the strip so that the second long edge can move vertically with respect to the other of the door and the door frame, wherein when the door is in an open position a vertical door edge is adapted to form a support for one of the rigid portions of the cover whereby the cover will be maintained in a generally convex shape while the door is being opened and closed.

* * * * *

UNITED STATES PATENT AND TRADEMARK OFFICE

CERTIFICATE OF CORRECTION

PATENT NO. : 6,497,073 B2
DATED : December 24, 2002
INVENTOR(S) : Stephen Robert Webb It is certified that error appears in the above-identified patent and that said Letters Patent is hereby corrected as shown below:

Title page, Item [54] and Column 1, line 1,
Title, "DOOR SAFETY DEVICE" has been replaced with -- DOOR SAFETY DEVICE WITH VERTICALLY MOVEABLE EDGE --;
Item [76], Inventor, "BAU" has beed replaced with -- 6AU --.

Signed and Sealed this

Fifth Day of August, 2003

JAMES E. ROGAN
*Director of the United States Patent and Trademark Office*